US006814491B1

(12) United States Patent
Tang

(10) Patent No.: US 6,814,491 B1
(45) Date of Patent: Nov. 9, 2004

(54) SEALING BAG

(76) Inventor: Wen-Ching Tang, 4F-5, No. 659, Chung Cheng Rd., Hsin Chuang City, Taipei (TW)

( * ) Notice: Subject to any disclaimer, the term of this patent is extended or adjusted under 35 U.S.C. 154(b) by 43 days.

(21) Appl. No.: 10/397,805

(22) Filed: Mar. 27, 2003

(51) Int. Cl.[7] ..... B65D 33/01; B65D 30/08
(52) U.S. Cl. ..... 383/100; 383/109; 206/524.8
(58) Field of Search ..... 383/100, 63, 109, 383/116; 206/524.8

(56) References Cited

U.S. PATENT DOCUMENTS 3,625,348 A * 12/1971 Titchenal et al. ..... 206/484
RE30,098 E * 9/1979 Titchenal et al. ..... 206/484
5,540,500 A * 7/1996 Tanaka ..... 383/43
5,701,996 A * 12/1997 Goto et al. ..... 206/287
5,804,265 A * 9/1998 Saad et al. ..... 428/35.2
5,894,929 A * 4/1999 Kai et al. ..... 206/524.8
5,965,224 A * 10/1999 Chen et al. ..... 428/35.2
5,973,768 A * 10/1999 Mazion et al. ..... 355/72
6,116,781 A * 9/2000 Skeens ..... 383/100
6,156,363 A * 12/2000 Chen et al. ..... 426/410
6,357,915 B2 * 3/2002 Anderson ..... 383/100

* cited by examiner

*Primary Examiner*—Jes F. Pascua
(74) *Attorney, Agent, or Firm*—Varndell & Varndell, PLLC

(57) ABSTRACT

A sealing bag is formed by a nylon film and a PE film added with chemical static solution is formed as a double layer compound material. Thereby, the edges of the double layer compound material can be sealed. The opening of the sealing bag contains a seal-retaining element. The area near the bottom of the bag is formed with at least one stop portion having a predetermined length and at least one vent. At least one gap channel is formed between the stop portion and the edge of the bag. An air channel is formed between the stop portion and the vent. The vent and the air channel are alternatively arranged.

4 Claims, 5 Drawing Sheets

SEALING BAG

BACKGROUND OF THE INVENTION (a) Field of the Invention

The present invention relates to a sealing bag, and particularly to a sealing bag in which the sealing bag of the present invention is formed by a nylon film and a polyethylene (PE) film added with chemical static solution or cling agent additive, so as to form as a double layer compound material. Thereby, the edges of the double layer compound material are sealed to form a sealing bag. When air is extruded out, by the electric static effect, the PE film at the inner layer will seal automatically so that air will not flow into the bag.

(b) Description of the Prior Art

In the prior art, the opening of a sealing bag is installed with a seat retainer (for example, at least one strip) for receiving object and then sealing the object, for example, those disclosed in U.S. Pat. No. 5,540,500. A bottom of the sealing bag is installed with a plurality of vents with a check valve, so that air only vents out from the vents unidirectionally. Thus, the bag is in a vacuum condition and the volume of the bag is reduced. As a result, the structure is complicated and the cost is increased.

SUMMARY OF THE INVENTION

Accordingly, the primary object of the present invention is to provide a sealing bag formed by a Nylon film and a PE film added with chemical static solution so as to form as a double layer compound material. Thereby, the edges of the double layer compound material are sealed to form a sealing bag. In the sealing bag, the opening of the sealing bag is installed with a seal retaining element. The area near the bottom of the bag is formed with at least one stop portion having a predetermined length and at least one vent. When air is extruded out, by the electric static effect, the PE film at the inner layer will seal automatically, so that air will not flow into the bag. Thus, the volume of the bag is reduced and the interior of the bag approaches a vacuum condition.

Another object of the present invention is to provide a sealing bag, wherein a gap channel is formed between the stop portion and the edge of the bag, and an air channel is formed between the stop portion and the vent. The vent and the air channel are alternatively arranged. Thereby, air within the bag can be vented out from another vent at another side through the gap channel and the air channel. Thereby, it is only necessary to press the air channel flatly. An electric static adhesion is formed so that the bag is sealed. At this time, since the air channel is sealed completely, external air cannot enter into the bag from the vent.

A further object of the present invention is to provide a sealing bag, where there are a plurality of stop portions which are spaced arranged so as to form a plurality of gap channels and a plurality of vents which are arranged alternatively. A long air channel is formed between the plurality of stop portions and the plurality of vents.

DETAILED DESCRIPTION OF THE PREFERRED EMBODIMENTS

Figure 1:
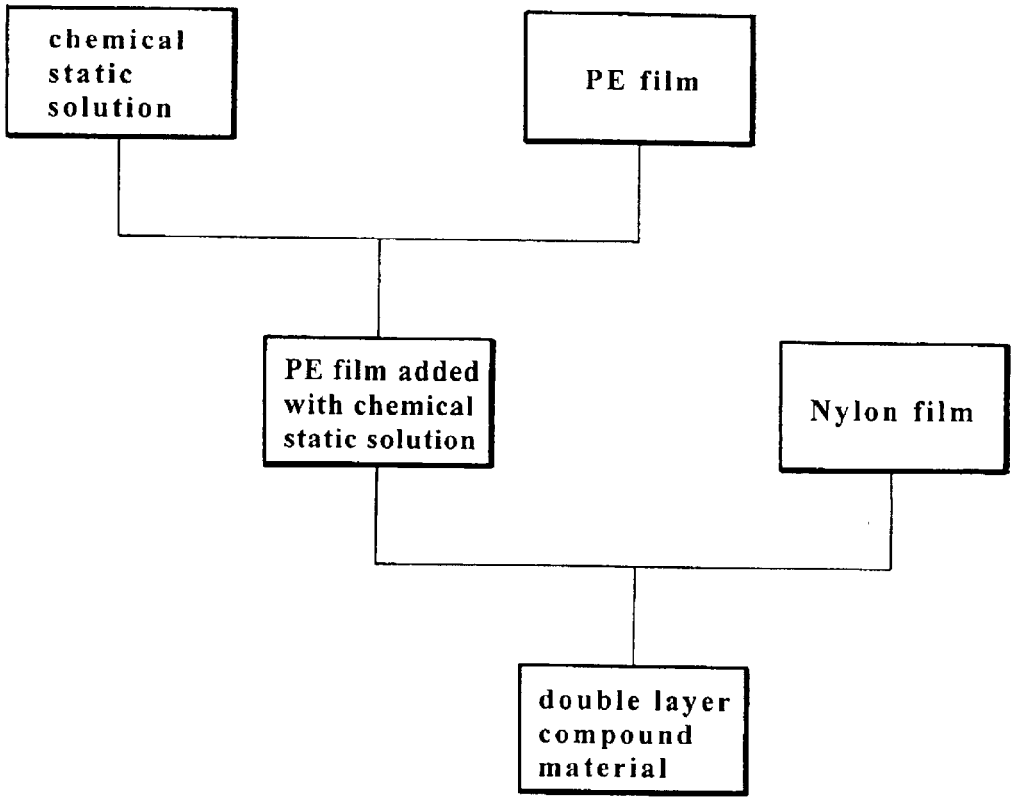
FIG. 1 is an assembly schematic view of the double layer compound material of the present invention.

Referring to FIG. 1, the sealing bag of the present invention is illustrated. The sealing bag is a double layer compound material formed by a nylon film and a PE film added with chemical static solution. The PE film added with chemical static solution contains about 92–95 wt % polyethylene and about 5–8 wt % of chemical static solution (cling agent additive). The PE film added with chemical static solution is at an inner layer and the PE film added with chemical static solution. Thereby, a sealing bag is formed.

Figure 2:
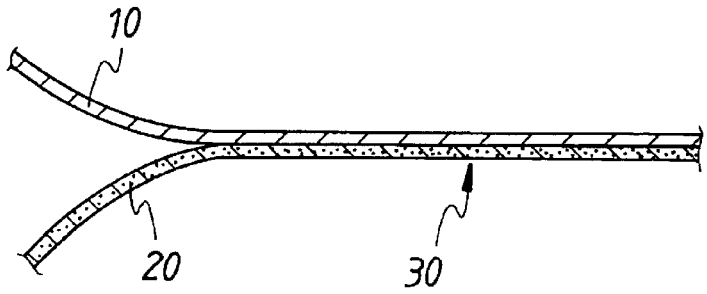
FIG. 2 is a schematic view showing the cross section of the double layer compound material of the present invention.
Figure 3:
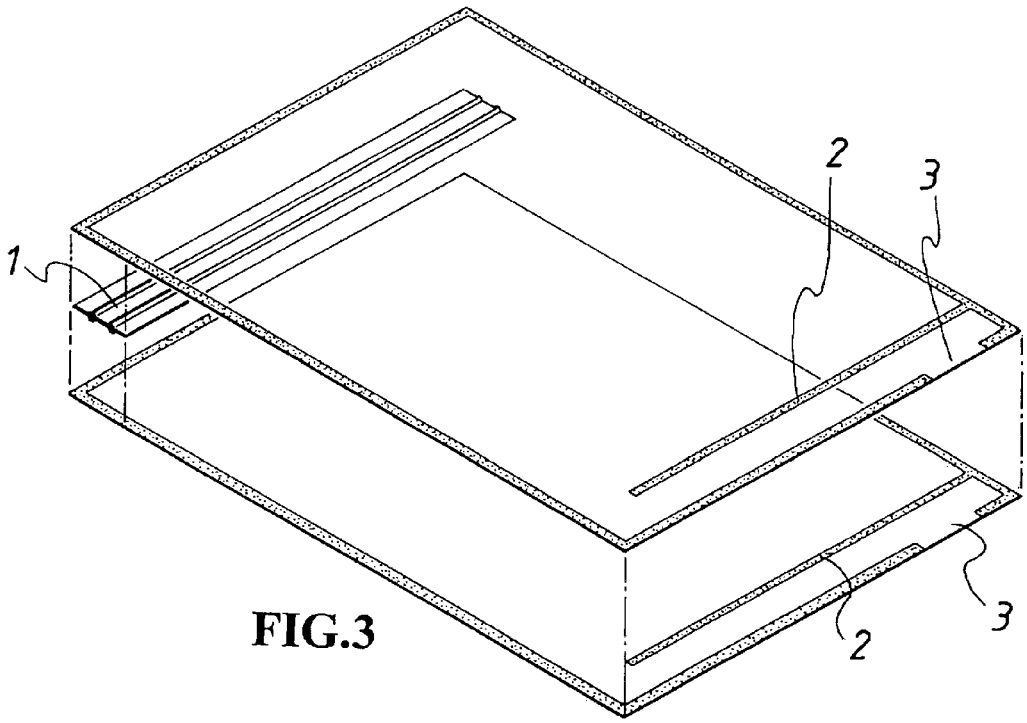
FIG. 3 is an exploded perspective view of the sealing bag of the present invention.
Figure 4:
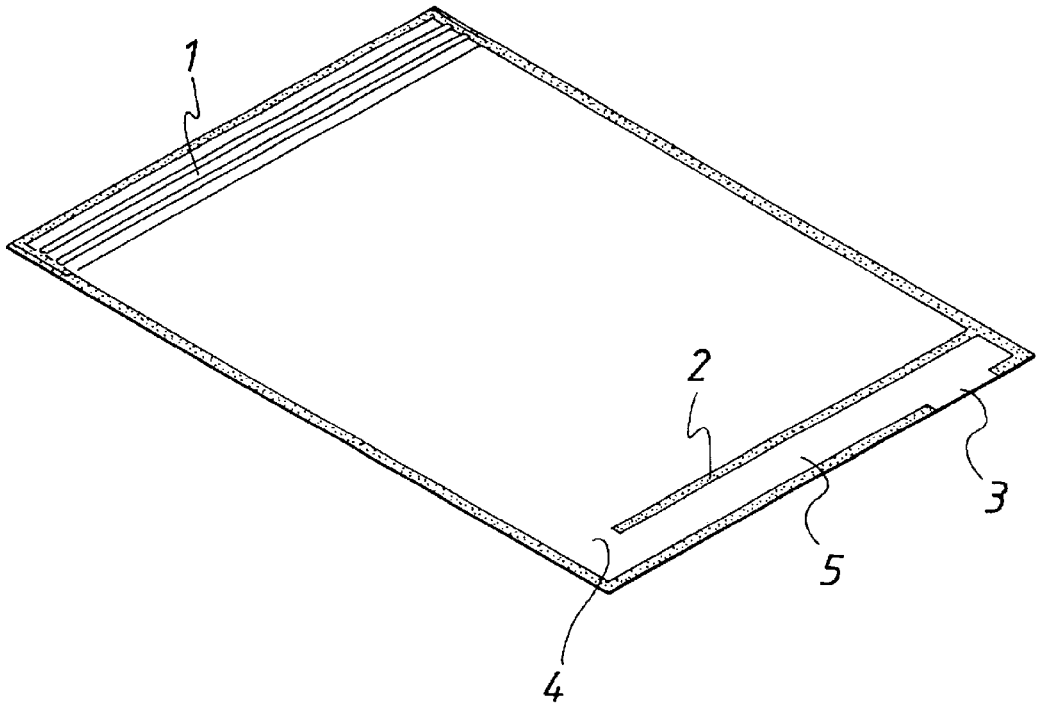
FIG. 4 is a schematic cross section view of the present invention.

Referring to FIG. 2, the sealing bag of the present invention is combined with a Nylon film 10 and a PE film added with chemical static solution, thereby forming a double layer compound material 30. By this arrangement, the edges of the double layer compound material 30 are sealed to form a sealing bag (referring to FIGS. 3 and 4). In the sealing bag, the opening of the sealing bag is installed with a seal-retaining element (as shown in the figure, at least one strip is installed). The area near the bottom of the bag is formed with at least one stop portion 2 having a predetermined length and at least one vent 3. When air is extruded out, by the electric static effect, the PE film 20 at the inner layer will seal automatically so that air will not flow into the bag. Thus, the volume of the bag is reduced and the interior of the bag approaches a vacuum condition.

A gap channel 4 is formed between the stop portion 2 and the edge of the bag and an air channel 5 is formed between the stop portion 2 and the vent 3. The vent 3 and the air channel 5 are alternatively arranged. Thereby, air within the bag can be vented out from another vent 3 at another side through the gap channel 4 and the air channel 5. Thereby, it is only necessary to press the air channel 5 flatly. An electric static adhesion is formed so that the bag is sealed. At this time, since the air channel 5 is sealed completely, external air cannot enter into the bag from the vent 3.

Figure 5:
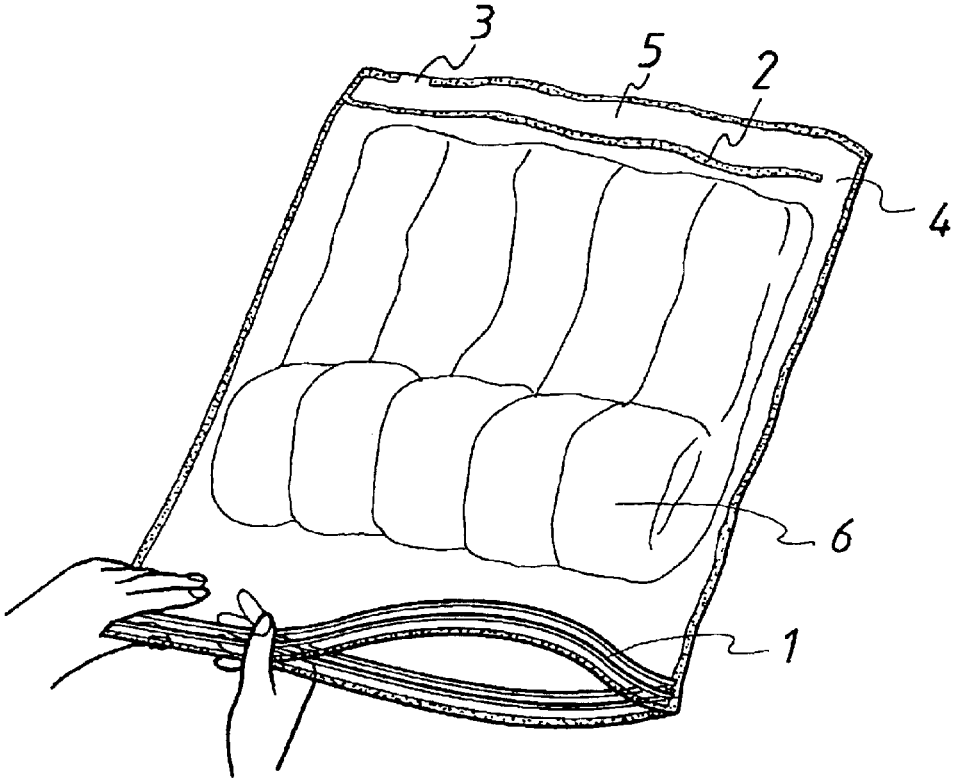
FIG. 5 is a schematic view showing the use of the present invention, where an object is placed in the bag of the present invention.
Figure 6:
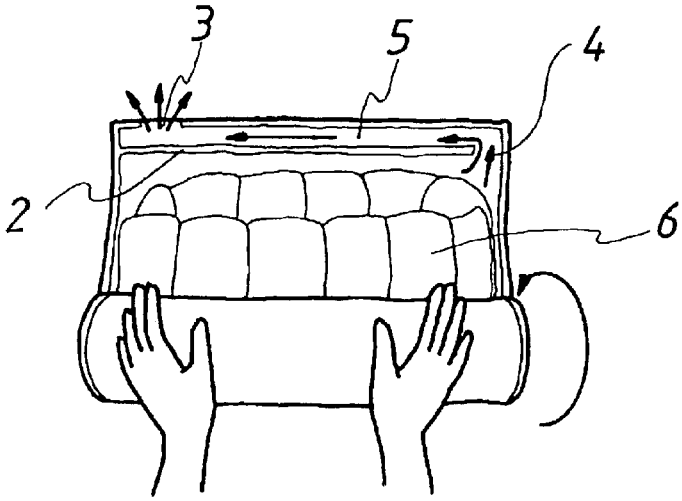
FIG. 6 is a schematic view showing the application of the present invention, where the sealing bag of the present invention with an object therein is wound. This winding action vents air in the sealing bag.

Referring to FIGS. 5 and 6, the application of the present invention is illustrated. When an object 6 is placed within the bag, at first, the sealing retainer 1 of the opening of the bag is sealed (referring to FIG. 5). Then, the bag is wound with the object 6 (referring to FIG. 6), so that air in the bag vents out from a vent 3 at another end through the gap channel 4 and air channel 5. Then, the long air channel 5 is pressed flatly so that the inner PE film seals automatically.

Figure 7:
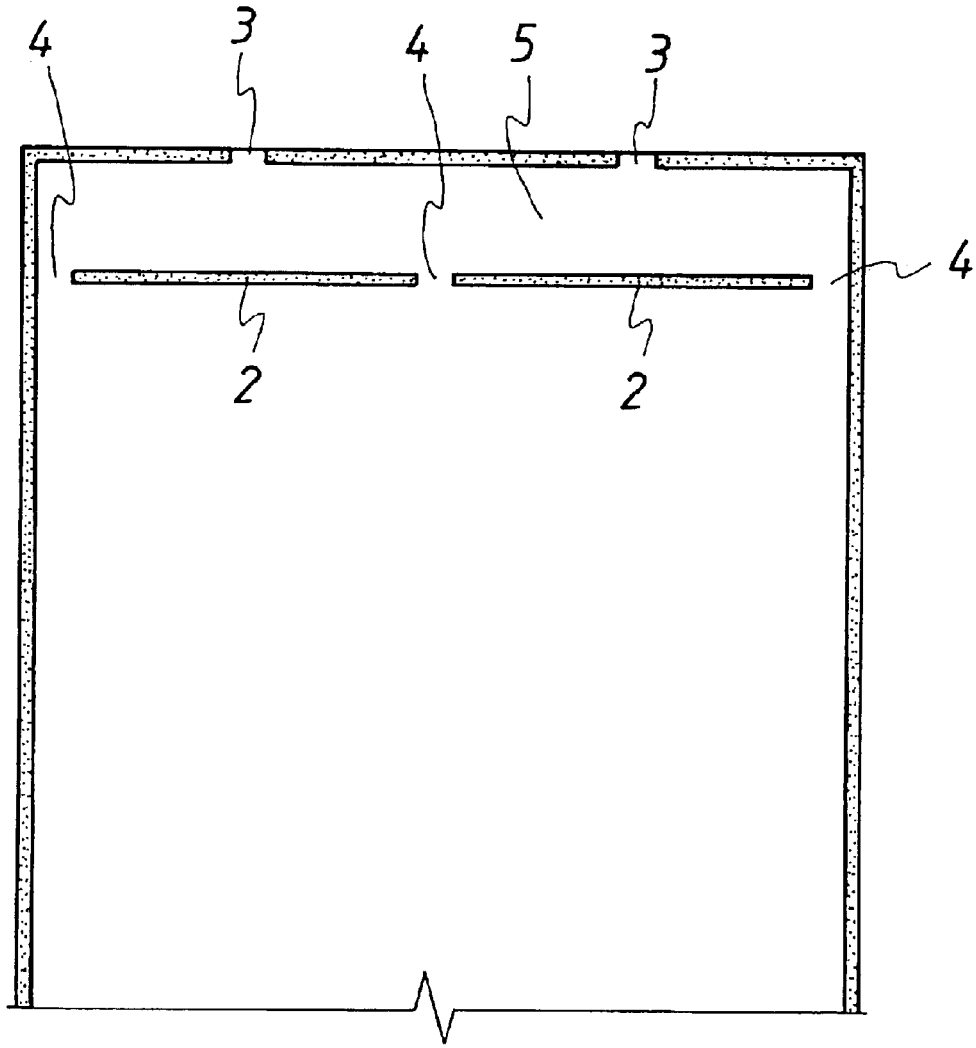
FIG. 7 shows another embodiment of the present invention.

The present invention is thus described. It will be obvious that the same may be varied in many ways. Such variations are not to be regarded as a departure from the spirit and scope of the present invention. For example, another embodiment of the present invention is illustrated in FIG. 7. In this embodiment, there is a plurality of stop portions 2 which are spaced and arranged to form a plurality of gap channels 4 and a plurality of vents 3 which are arranged alternatively. A long air channel 5 is formed between the plurality of stop portions 2 and a plurality of vents 3. Thus, air in the bag can be vented out from the plurality of gap channels 4 and the air channels 5. When the air channels 5 are pressed flatly, the PE film will seal by electric static effect. All such modifications as would be obvious to one skilled in the art are intended to be included within the scope of the following claims.

What is claimed is:

1. A sealing bag comprising double layer compound material being formed by a nylon film and a PE film added with chemical static solution, edges of the double layer compound material being sealed to form as a sealing bag; the sealing bag including an opening provided with a seal retaining element; an area adjacent a bottom of the bag being formed with at least one stop portion having a predetermined length and at least one vent, and at least one gap channel being formed between the stop portion and the edge of the bag.

2. The sealing bag as claimed in claim 1, wherein an air channel is formed between the stop portion and the vent.

3. The sealing bag as claimed in claim 1, wherein the vent and the air channel are alternatively arranged.

4. The sealing bag as claimed in claim 1, including a plurality of stop portions which are arranged to form a plurality of gap channels and a plurality of vents, and a long air channel is formed between the plurality of stop portions and the plurality of vents.

* * * * *